US005376523A

United States Patent [19]

Henry et al.

[11] Patent Number: 5,376,523

[45] Date of Patent: Dec. 27, 1994

[54] METHOD FOR CONTROLLING CHARACTERISTICS CURVE SHAPE FOR VARIABLE CONTRAST PHOTOGRAPHIC ELEMENTS

[75] Inventors: Marian S. Henry, Rochester; Sandra M. Finn, Honeoye Falls; Harry J. Price, Webster, all of N.Y.

[73] Assignee: Eastman Kodak Company, Rochester, N.Y.

[21] Appl. No.: 131,498

[22] Filed: Oct. 4, 1993

Related U.S. Application Data

[63] Continuation of Ser. No. 774,392, Oct. 10, 1991, abandoned.

[51] Int. Cl.[5] ..... G03C 1/29; G03C 1/005

[52] U.S. Cl. ..... 430/572; 430/504; 430/569; 430/574; 430/577; 430/585; 430/588

[58] Field of Search ..... 430/569, 572, 503, 509, 430/577, 511, 521, 570, 581, 576, 584, 585

[56] References Cited

U.S. PATENT DOCUMENTS

| | | | |
|---|---|---|---|
| 2,202,026 | 5/1940 | Renwick | 430/503 |
| 2,280,300 | 4/1942 | Potter et al. | 430/569 |
| 2,358,060 | 9/1944 | Davey | 430/571 |
| 2,384,598 | 9/1945 | Carroll | 430/571 |
| 2,620,272 | 12/1952 | Schwarz | 430/571 |
| 2,944,901 | 7/1960 | Carroll | 70/86 |
| 3,628,960 | 12/1971 | Merteel et al. | 430/571 |
| 4,175,967 | 11/1979 | Krause | 430/503 |
| 4,582,786 | 4/1986 | Ikeda et al. | 430/572 |
| 4,678,741 | 7/1987 | Yamada et al. | 430/445 |
| 4,987,063 | 1/1991 | Kampfer et al. | 430/550 |

FOREIGN PATENT DOCUMENTS

| | | |
|---|---|---|
| 547432 | 8/1942 | United Kingdom . |
| 547883 | 9/1942 | United Kingdom . |
| 1390247 | 4/1975 | United Kingdom . |

*Primary Examiner*—Thorl Chea

*Attorney, Agent, or Firm*—Gordon M. Stewart

[57] ABSTRACT

A process for controlling the silver halide grain-to-grain distribution of a variable contrast dye in a light sensitive silver halide emulsion layer of a variable contrast photographic element, and thereby adjusting the low contrast characteristic curve of the element, is disclosed comprising the process steps of adding a green variable contrast sensitizing dye of the following formula (I) to a silver halide emulsion for a variable contrast photographic element, adding a blue sensitizing dye of the following formula (II) to the same silver halide emulsion, and coating the emulsion on a support. In the process, the green and blue sensitizing dyes are added to the emulsion at substantially the same time, and the green dye is added in an amount less than that required to impart maximum sensitivity to all of the silver halide in the emulsion.

(I)

(II)

In formula (I), $R^1$, $R^2$, $R^6$ and $R^7$ each independently represent hydrogen, halogen, hydroxy, or substituted or unsubstituted alkyl, alkenyl, alkoxy, alkylamino, alkylthio, aryl, aryloxy, arylamino or arylthio. $R^3$, $R^4$ and $R^5$ each independently represent substituted or unsubstituted alkyl or aryl. X represents a counterion as needed to balance the charge of the molecule. In formula (II), Z represents the atoms necessary to complete an optionally further substituted five- or six-membered heterocyclic ring, $R^8$ represents substituted or unsubstituted alkyl or aryl, and $R^9$ represents hydrogen, substituted or unsubstituted alkyl or aryl, or a heterocycle.

13 Claims, 3 Drawing Sheets

METHOD FOR CONTROLLING CHARACTERISTICS CURVE SHAPE FOR VARIABLE CONTRAST PHOTOGRAPHIC ELEMENTS

This is a continuation of application Ser. No. 07/774,392, filed Oct. 10, 1991, now abandoned.

FIELD OF THE INVENTION

This invention relates to dyes, and more particularly to their use in variable contrast photographic materials sensitive in the green and blue regions of the spectrum in order to control the characteristic curve shape of such elements.

BACKGROUND OF THE INVENTION

When making prints from photographic negatives, it is desirable to use photographic paper which has a contrast selected to achieve satisfactory tone-reproduction of the original image based upon the contrast of the negative. Papers having higher contrasts, for example, are useful in printing negatives that themselves exhibit low contrasts, so that a satisfactory final print can be achieved. As such, photographic manufacturers offer several grades of photographic paper. In order to avoid the need for separate papers of different grades, "variable contrast" papers possessing the ability to achieve different, selected, contrasts depending upon the wavelength of exposing light have also been employed.

Various methods for obtaining variable, or selective, contrast properties in single photographic elements have been proposed. Early proposals included photographic elements containing two distinct emulsions, such as a high contrast silver chloride emulsion which has been dyed so as to render it sensitive to green light and a low contrast silver bromide or silver chlorobromide emulsion with inherent sensitivity to blue light as disclosed in U.S. Pat. No. 2,202,026. With such a combination of emulsions, a high contrast negative could be exposed through a filter passing only blue light, to which the low contrast emulsion is sensitive, thus producing a print of normal contrast. Alternatively, a low contrast negative could be exposed through a filter passing only green light to which only the high contrast emulsion is sensitive, thus again producing a print of normal contrast.

Use of emulsions of different halide types in order to achieve difference in contrast, however, resulted in complications due to different rates of development of the two emulsions. For negatives which do not fall at either extreme of contrast, and which thus require both emulsions to contribute to the final image in varying amount, the different rates of development made it difficult to judge accurately the adjustment of development time and exposure to optimize the final appearance of a print. Image tone was also found to vary depending upon the relative contribution of each emulsion to the final print.

A second approach to providing a variable contrast system involved the use of a single type of emulsion, but the whole emulsion was not completely dyed. This approach requires the use of a sensitizing dye which itself alters the contrast of the emulsion it is used with. A portion (e.g. less than half) of the emulsion may be dyed with sufficient dye to give the silver halide grains of that portion high sensitivity to a wavelength outside the inherent sensitivity and a different contrast without exceeding the adsorptive capacity of the grains, and that portion then mixed with the undyed portion before coating as described in U.S. Pat. No. 2,384,598. Alternatively, the entire single emulsion may be dyed with a restricted amount (less than that required to impart maximum sensitivity to all of the silver halide in the emulsion) of a sensitizing dye which controls the contrast of the emulsion depending upon the amount of the dye used as described in U.S. Pat. No. 2,280,300. A variable contrast effect is obtained as a result of an uneven grain-to-grain distribution of the restricted amount of dye which apparently results from preferential adsorption of the dye on some of the silver halide grains.

In many conventional single emulsion type variable contrast systems, an inherently blue sensitive, relatively high contrast silver halide emulsion is partially sensitized with a green spectral sensitizing dye which also reduces the contrast of the emulsion for exposures to green light. The emulsion may also be dyed with a blue spectral sensitizing dye to enhance the inherent sensitivity in the blue region. Benzimidazolooxacarbocyanine sensitizing dyes have been found to be effective green sensitizing dyes for single emulsion type variable contrast photographic elements. Benzimidazolooxacarbocyanine dyes are disclosed in U.S. Pat. No. 4,987,063, which is specifically directed towards variable contrast elements, and British Patent Specification 1,390,247, the disclosures of which are incorporated by reference.

An important limitation of the preceding approaches to providing variable contrast elements is that they do not allow convenient means to control the green spectral sensitizing dye grain-to-grain distribution, which determines the low contrast characteristic curve obtained upon exposure in the spectral region absorbed by the dye. Characteristic curves are convenient means for describing the sensitometric properties of photographic materials, and are most commonly presented in the form of "D-log E" curves which plot the output variable density (D) against the logarithm of the input variable exposure (E). Such characteristic curves are discussed in James, *The Theory of the Photographic Process* 4th, 1977, pages 501–510, the disclosure of which is incorporated by reference.

Improper dye distribution can result in distorted characteristic curves, especially in intermediate exposure regions. The use of photographic elements with distorted low contrast characteristic curves may result in a low quality of prints obtained from many negatives.

Prior approaches to manipulating curve shapes for intermediate exposures include introducing some additional component by means of which the overall contrast is altered. For example, U.S. Pat. No. 2,944,901 discloses adding absorber dyes as a means of controlling contrast. This approach, however, results in fairly large and undesirable speed losses.

Other approaches involve constructing the photographic element such that various independent components determine the shape of different regions of the characteristic curve. U.S. Pat. No. 2,620,727, for example, discloses dividing an emulsion into several portions, wherein one portion remains undyed, one portion is essentially completely dyed, the remaining portions are each dyed with progressively less dye, and all the portions are recombined before coating. By varying the amount of dye, the number of portions, and the relative amount of each portion to the whole, the grain-to-grain distribution of the dye may be controlled and the resulting shape of the low contrast characteristic curve adjusted. The method is, of course, awkward and complicated to manufacture.

U.S. Pat. No. 4,175,967 proposes combining at least two variable contrast sub-systems of different sensitivities into a single element. Each sub-system is sensitized in a different spectral region, by which means the user can independently adjust lower and upper contrasts. With intermediate filter dye layers this method could involve the coating of as many as 30 different layers, making it difficult to manufacture. The product is also difficult to use since regions of the characteristic curve respond to exposure variation in different spectral regions.

It would be desirable to provide an improved method of controlling the grain-to-grain distribution of a variable contrast dye, and thereby adjusting the low contrast characteristic curve of a variable contrast photographic material, which did not involve complex manufacturing and operating procedures. It is a further object of the invention to provide a method by which the low contrast characteristic curve may be adjusted independently of the high contrast characteristic curve.

SUMMARY OF THE INVENTION

These and other objects are met in accordance with the present invention which comprises the process steps of adding a green variable contrast sensitizing dye of the following formula (I) to a silver halide emulsion for a variable contrast photographic element, and adding a blue sensitizing dye of the following formula (II) to the same silver halide emulsion, wherein the green and blue sensitizing dyes are added to the emulsion at substantially the same time, and the green dye is added in an amount less than that required to impart maximum sensitivity to all of the silver halide in the emulsion.

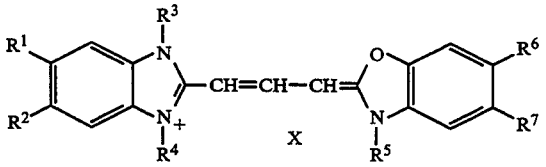

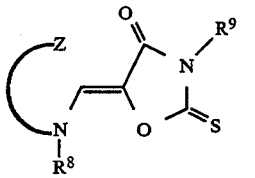

In formula (I), $R^1$, $R^2$, $R^6$ and $R^7$ each independently represent hydrogen, halogen, hydroxy, or substituted or unsubstituted alkyl, alkenyl, alkoxy, alkylamino, alkylthio, aryl, aryloxy, arylamino, or arylthio. $R^3$, $R^4$ and $R^5$ each independently represent substituted or unsubstituted alkyl or substituted or unsubstituted aryl. X represents a counterion as needed to balance the charge of the molecule.

In formula (II), Z represents the atoms necessary to complete an optionally further substituted five- or six-membered heterocyclic ring, while $R^8$ represents substituted or unsubstituted alkyl or aryl and $R^9$ represents hydrogen, substituted or unsubstituted alkyl or aryl, or a heterocycle.

A further embodiment of the invention comprises a variable contrast photographic element made from the above process.

DESCRIPTION OF PREFERRED EMBODIMENTS

Figure 1:
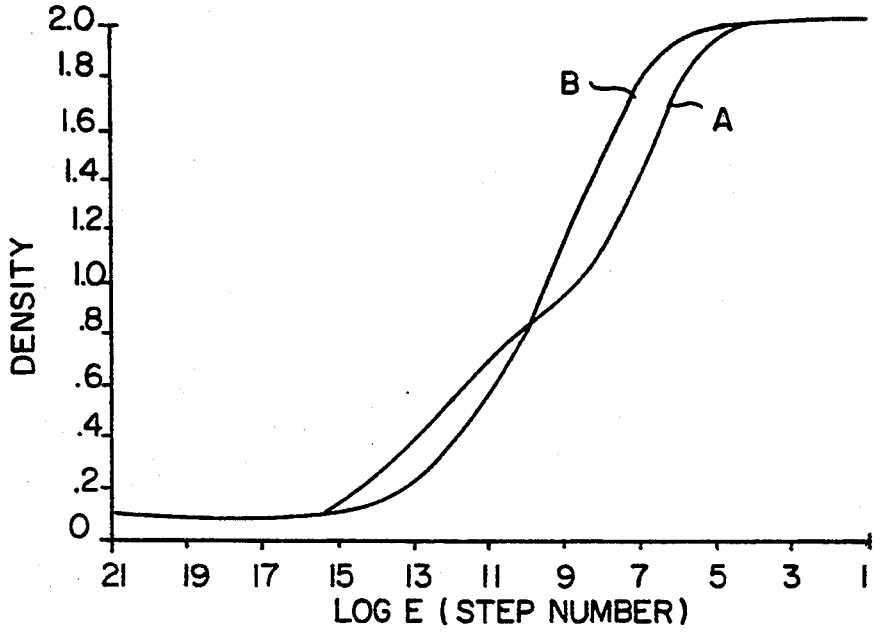
FIG. 1 is a D-Log E graph showing the low contrast characteristic curves for coatings A and B of Example 1.

In formula (I), $R^1$, $R^2$, $R^6$ and $R^7$ represent hydrogen, halogen (e.g., fluoro, chloro, bromo), hydroxy, substituted or unsubstituted alkyl, alkenyl, alkoxy, alkylamino or alkylthio (preferably of from 1 to about 6 carbon atoms, e.g., methyl, ethyl, propyl, methoxy, ethoxy, methylthio, etc.), or substituted or unsubstituted aryl, aryloxy, arylamino or arylthio (preferably of from about 5 to about 12 carbon atoms, e.g., phenyl, phenyloxy and phenylthio). Aryl $R^1$, $R^2$, $R^6$ and $R^7$ groups may be appended from or fused with (for example to form a naphthyl ring structure) the benzoxazole and benzimidazole nuclei. Examples of substituents for alkyl, alkenyl, alkoxy, alkylamino, alkylthio, aryl, aryloxy, arylamino and arylthio $R^1$, $R^2$, $R^6$ and $R^7$ include halogen, hydroxy, and other common substituents known in the art. In a preferred embodiment, at least two of $R^1$, $R^2$, $R^6$ and $R^7$ are other than hydrogen. In a particularly preferred embodiment, $R^1$ and $R^6$ are hydrogen, $R^2$ is trifluoromethyl, and $R^7$is phenyl.

Also in Formula (I), $R^3$, $R^4$ and $R^5$ are substituted or unsubstituted alkyl (preferably of from 1 to about 6 carbon atoms) or substituted or unsubstituted aryl (preferably of from about 5 to about 12 carbon atoms, e.g. phenyl). Examples of unsubstituted alkyls include methyl, ethyl, propyl, butyl, pentyl, and hexyl. Preferably, one of $R^3$, $R^4$, and $R^5$ is a substituted with an anionic substituent, and no counterion X is needed. Examples of substituents include one or more of sulfo, sulfato, carboxyl, amides, esters, halogens, cyano, substituted or unsubstituted aryls, and other substituents commonly used in photographic sensitizing dyes. Examples of substituted alkyl include sulfoalkyl such as sulfopropyl, sulfobutyl, etc.; carboxyalkyl such as carboxyethyl, carboxybutyl, etc.; sulfatoalkyl such as sulfatoethyl, sulfatobutyl, etc.; N,N-dimethylcarbamoylmethyl; methylsulfonylcarbamoylmethyl; sulfoethylcarbamoylmethyl; ethoxycarbonylmethyl; fluoroalkyl such as trifluoroethyl; cyanoalkyl; etc. In one embodiment of the invention, one of $R^3$, $R^4$ and $R^5$ is a sulfoalkyl group of from 1 to about 6 carbon atoms.

In a preferred embodiment, $R^5$ represents a substituent containing an electron withdrawing group. Electron withdrawing groups in organic compounds are well-known in the art, such as described in J. March, *Advanced Organic Chemistry*, 3rd Ed., John Wiley & Sons, New York 1985, pp. 16–17, 238, the disclosure of which is incorporated herein by reference in its entirety. Examples of such groups include fluoro, cyano, acyl, fluoroalkyl, aminocarbonyl, and alkoxycarbonyl. In a most preferred embodiment, $R^5$ is a fluoro-substituted alkyl group such as trifluoroethyl. Use of dyes of formula (I) having an $R^5$ substituent which contains an electron withdrawing group has been found to beneficially reduce the sensitivity of variable contrast photographic elements at wavelengths longer than 570 nm, thereby enhancing safelight tolerance, and variable contrast photographic elements containing such dyes are the subject matter of commonly assigned, copending, concurrently filed U.S. Ser. No. 774,440 of Price et al., the disclosure of which is incorporated by reference.

Depending upon other substituents, a counter ion X may be necessary to balance the charge of the dye molecule. For example, if the dye molecule is substituted with two anionic substituents (e.g., sulfo), then X will be a cation. If the dye molecule is substituted with only one anionic substituent, the counterion X is not present. If the dye molecule is substituted with no anionic substituents, X will be an anion. Such counter ions are well known in the art and examples thereof include cations such as sodium, potassium, triethylammonium, and the like, and anions such as chloride, bromide, iodide, p-toluene sulfonate, methane sulfonate, methyl sulfate, ethyl sulfate, perchlorate, fluoroborate, and the like.

In formula (II), Z represents the atoms necessary to complete an optionally further substituted five- or six-membered heterocyclic ring. Examples of heterocyclic rings include pyridine, oxazole, thiazole, selenazole, benzoxazole, benzothiazole, benzoselenazole, naphthoxazole, naphthothiazole, naphthoselenazole, etc. Preferred heterocyclic rings include pyridine, oxazole, thiazole, and their benzo-condensed derivatives.

$R^8$ represents substituted or unsubstituted alkyl (preferably of from 1 to about 6 carbon atoms) or aryl (preferably of from about 5 to about 12 carbon atoms). $R^9$ represents hydrogen, substituted or unsubstituted alkyl (preferably of from 1 to about 6 carbon atoms) or aryl (preferably of from about 5 to about 12 carbon atoms), or a heterocycle (preferably of five or six ring atoms). Examples of substituted and unsubstituted alkyl for $R^8$ and $R^9$ include those listed for $R^3$, $R^4$, and $R^5$ above. In one embodiment of the invention, $R^8$ and $R^9$ are each unsubstituted alkyl of from 1 to 4 carbon atoms. Examples of substituted and unsubstituted aryl and heterocycles include phenyl, carboxy or sulfo substituted phenyl, and pyridinyl.

Specific examples of dyes according Formula (I) and (II) include the following dyes I-1 through I-14 and II-1 through II-10.

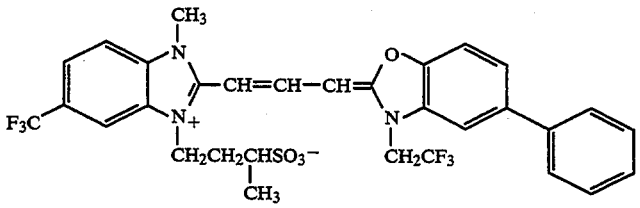

I-1

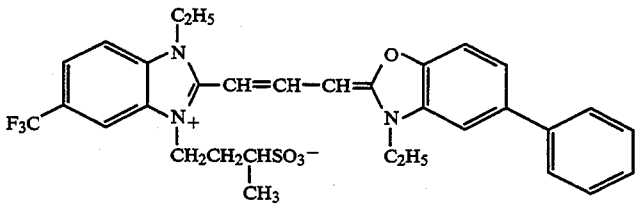

I-2

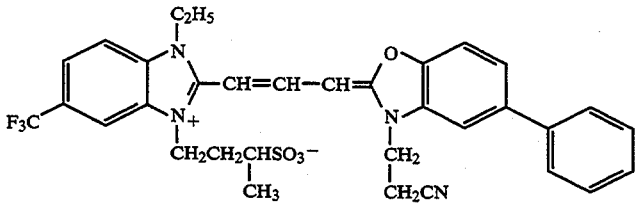

I-3

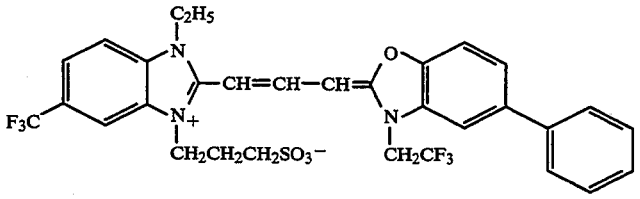

I-4

-continued
I-5
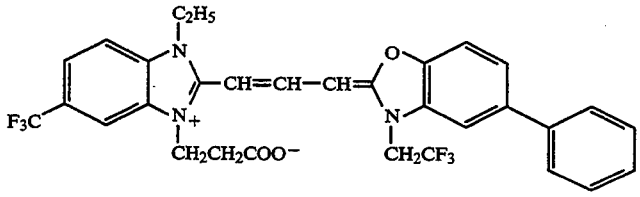
I-6
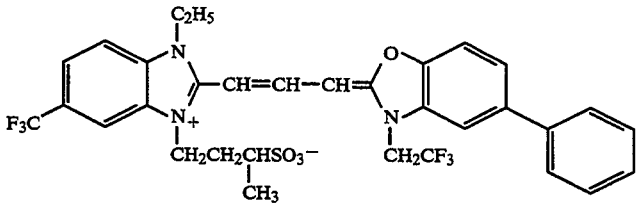
I-7
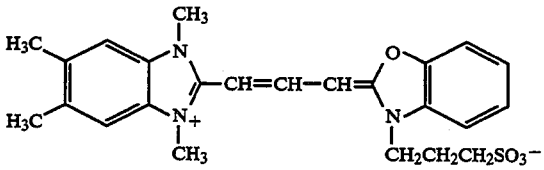
I-8
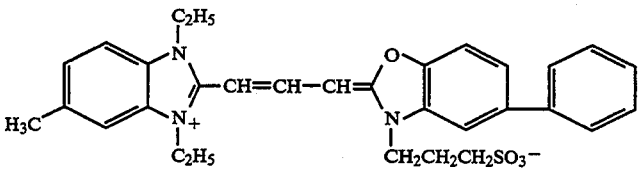
I-9
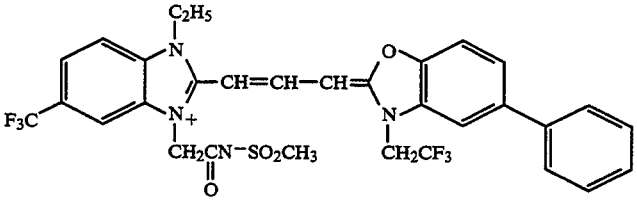
I-10
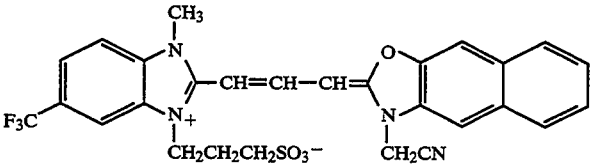
I-11
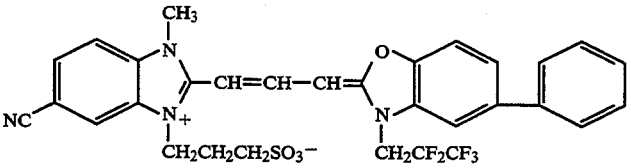
I-12
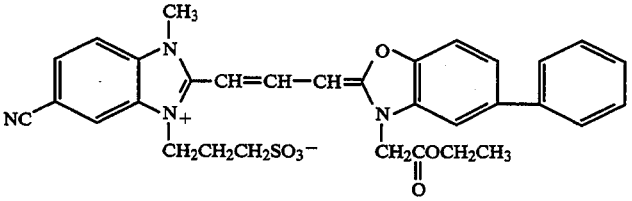

-continued
I-13
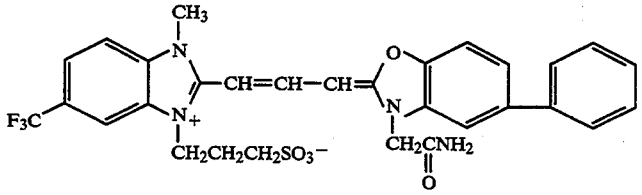
I-14
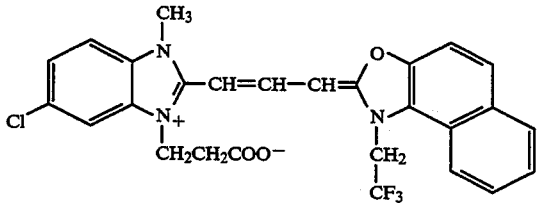
II-1
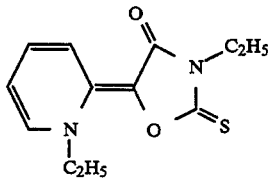
II-2
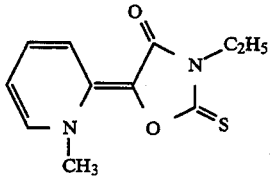
II-3
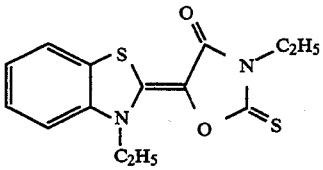
II-4
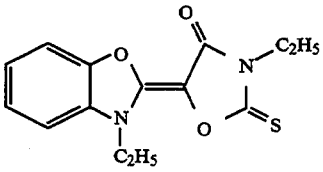
II-5
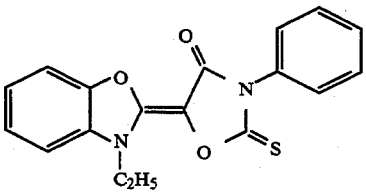
II-6
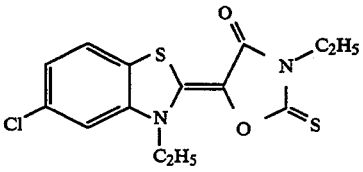

-continued

II-7

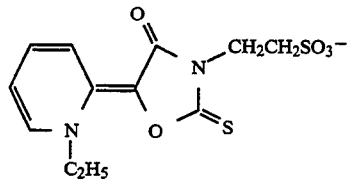

II-8

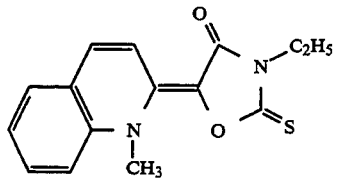

II-9

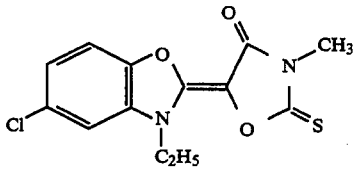

II-10

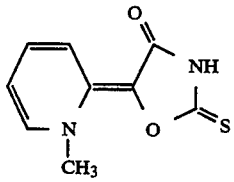

The dyes of formulas (I) and (II) can be prepared according to techniques that are well-known in the art, such as described in Hamer, *Cyanine Dyes and Related Compounds,* 1964 and James, *The Theory of the Photographic Process* 4th, 1977, as well as the above referenced patents.

The amount of sensitizing dye (I) that is useful in the invention is preferably selected to be sufficient to achieve a mono-layer of dye adsorbed to about 0.5 to 20% of the silver halide grain surface area. Depending upon the silver halide grain shape and size, this coverage corresponds to a range of from about 1 to about 1000 μmol dye per mol of silver. Optimum dye concentrations can be determined by methods known in the art.

The amount of sensitizing dye (II) that is useful in the invention is not critical, and may be selected to be sufficient to achieve a mono-layer of dye adsorbed to about 2 to 80% of the total silver halide grain surface area. Depending upon the silver halide grain shape and size, this coverage corresponds to a range of from about 10 to about 5000 μmol dye per mol of silver. While the amount of blue sensitizing dye (II) is not critical, it is critical that at least a portion of the blue sensitizing dye added to the emulsion be added at substantially the same time as the green sensitizing dye (I) is added in order to achieve the beneficial grain-to-grain distribution of the green variable contrast dye and the resulting modified low contrast characteristic curve of the invention. Addition of the dyes at "substantially the same time" is intended to cover the period of time in which the green sensitizing dye is being adsorbed to the silver halide grain surface, as it is the interaction of the dyes during such adsorption period which leads to the beneficial effects of the invention. Additional blue dye may also be added before or after addition of the green dye.

For practical considerations, a green dye and a blue dye of the above formulas should be selected which do not have a substantial spectral absorbance overlap. For example, if the blue dye exhibits substantial spectral sensitivity extending into the green range (e.g., longer than about 490 nm), it may undesirably mask the variable contrast effect of the green dye. Selection of green and blue dyes within the above formulas which provide adequate spectral absorbance separation for variable contrast photographic elements is within the skill of the artisan.

The silver halide used in the practice of the invention can be of any known type, such as silver bromoiodide, silver bromide, silver chloride, silver chlorobromide, and the like. The form of the silver halide grains is not critical and essentially any type of silver halide grains can be used in the practice of the invention. The grains, for example, may be in the form of regular cubes or octahedrons, spherical, or tabular in form. The grain size of the silver halide may have any distribution known to be useful in photographic compositions, and may be either polydisperse or monodisperse. Conventional grain diameters range from about 0.1 to about 1 μm.

The silver halide grains to be used in the invention may be prepared according to methods known in the art, such as those described in *Research Disclosure*, Item 308119, December, 1989 [hereinafter referred to as *Research Disclosure I*] and James, The *Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., aurous sulfide) and others known in the art. Compounds and techniques useful for chemical sensitization of silver halide are known in the art and described in *Research Disclosure I* and the references cited therein.

Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount known to be useful in photographic emulsions.

The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30 to 80° C., as illustrated in *Research Disclosure*, June 1975, item 13452 and U.S. Pat. No. 3,772,031.

Other addenda include antifoggants, stabilizers, filter dyes, light absorbing or reflecting pigments, vehicle hardeners such as gelatin hardeners, and coating aids. These addenda and methods of their inclusion in emulsion and other photographic layers are well-known in the art and are disclosed in *Research Disclosure I* and the references cited therein. The emulsion may also include brighteners, such as stilbene brighteners. Such brighteners are well-known in the art and are used to counteract dye stain.

The emulsion layer containing silver halide sensitized with the dyes of formula (I) and (II) can be coated simultaneously or sequentially with other emulsion layers, subbing layers, filter dye layers, interlayers, or overcoat layers, all of which may contain various addenda known to be included in photographic elements. These include plastisizers, antifoggants, antistatic agents, optical brighteners, light-absorbing or light-scattering pigments, and the like.

The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic elements of the invention can be processed in any of a number of well-known photographic processes utilizing any of a number of well-known processing compositions, described, for example, in *Research Disclosure I*, or in James, *The Theory of the Photographic Process* 4th, 1977.

The following examples are provided to further illustrate the invention.

EXAMPLE 1

A silver chlorobromide (55 mol % Cl) emulsion of cubic morphology with edgelength equal to 0.34 microns was chemically sensitized with sulfur-plus-gold and held at 40° C. To 0.030 moles of this emulsion was added variable contrast dye I-1 at the ratio of 0.06 mmol/Ag mol. This dye was added from a methanolic solution with a concentration equal to 0.42 g/L. After 10 minutes the dye II-1 was added at the ratio of 0.30 mmol/Ag mol from a methanolic solution with a concentration equal to 4 g/L. Additional gelatin was added and the sample was coated with suitable addenda on a paper support. This constitutes coating A. A second sample was prepared as above with the exception that the concentration of the solution of dye I-1 was 0.21 g/L. The same level of dye I-1 was added; thus twice the volume of methanol was introduced with the variable contrast dye relative to coating A. This constitutes coating B. These coatings were exposed through KODAK POLYCONTRAST II PC 0 filter material (green exposure, allowing light of wavelength longer than 490 nm) and processed for 60 seconds in KODAK DEKTOL black and white paper developer, stopped, fixed, washed, and dried.

The low contrast characteristic curves of coatings A and B are shown in FIG. 1. In FIGS. 1–6, the relative exposure intensity values are marked in terms of step numbers. Each step represents a difference of 0.15 log E. Therefore, each two steps equal 0.30 log E, and thus represents a doubling of exposure intensity as log 2=0.30. The results show that the grain-to-grain distribution of dye I-1, which determines the curve shape, can be altered by increasing the amount of solvent added with the dye at the point of contact with the emulsion.

Preparation of coating A was repeated except that a 0.024 mol portion of the emulsion was used. This constitutes coating C. Another sample was prepared in the same way except that the solution of dye II-1 was added to the solution of dye I-1 and the combined solution was then added in place of the dye I-1 solution. This constitutes coating D. Coatings C and D were exposed and processed as above.

Two additional samples were prepared as variations on coating C. In the first variation (coating E) the solution of dye II-1 was added before the addition of dye I-1 with a 10 minute hold between addition of the two dyes. In the second variation (coating E), dye II-1 was added during the chemical sensitization.

Figure 2:
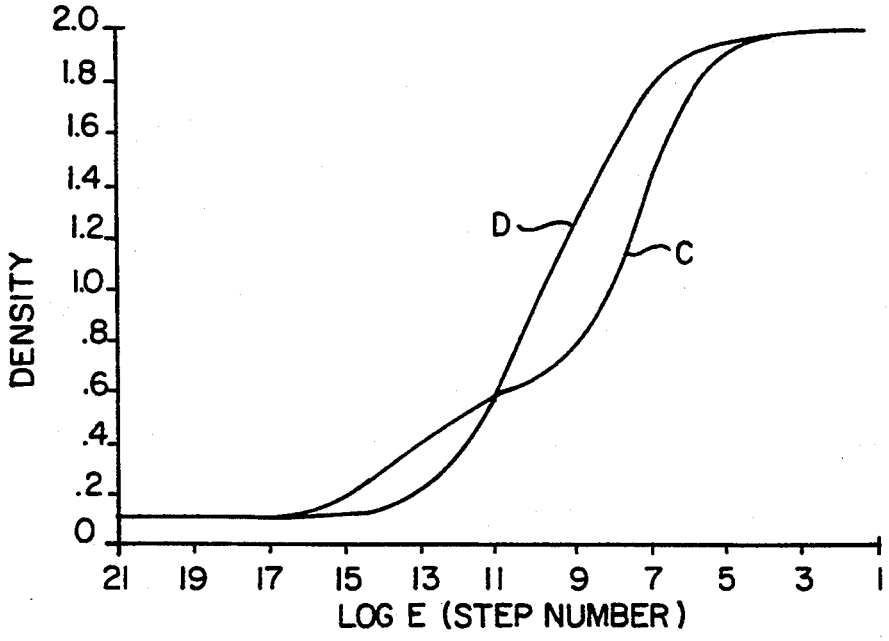
FIG. 2 is a D-Log E graph showing the low contrast characteristic curves for coatings C and D of Example 1.
Figure 3:
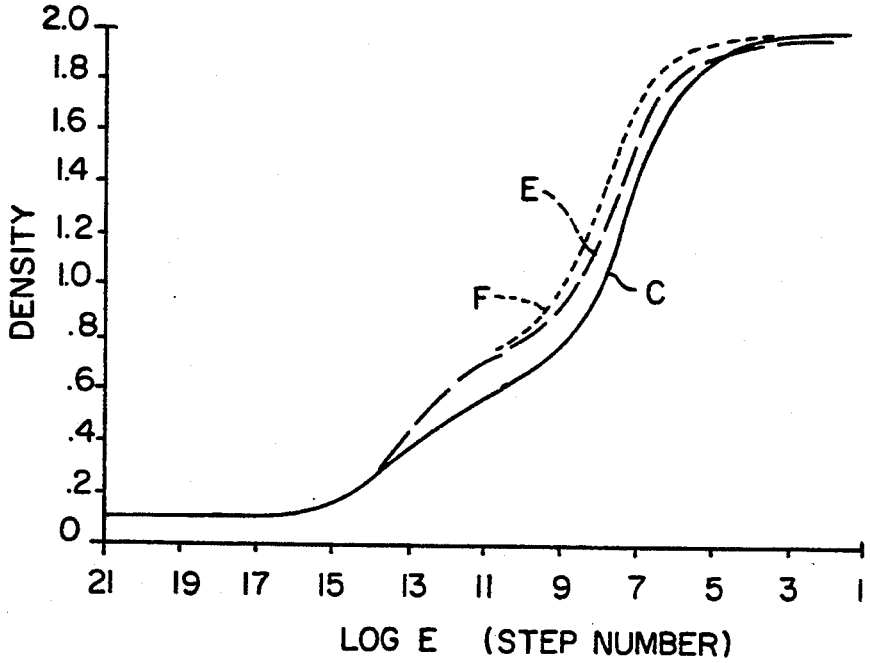
FIG. 3 is a D-Log E graph showing the low contrast characteristic curves for coatings E and F of Example 1.

The low contrast characteristic curves for coatings C and D are shown in FIG. 2 and for coatings E and E are shown in FIG. 3. The curves of FIG. 2 show that additional solvent for control of curve shape is unnecessary if a dye of formula (II) is added simultaneously with the variable contrast dye of formula (I). The results of FIG. 3 show that addition of dyes at other points during the sample preparation process do not produce the desirable results of the invention.

Figure 4:
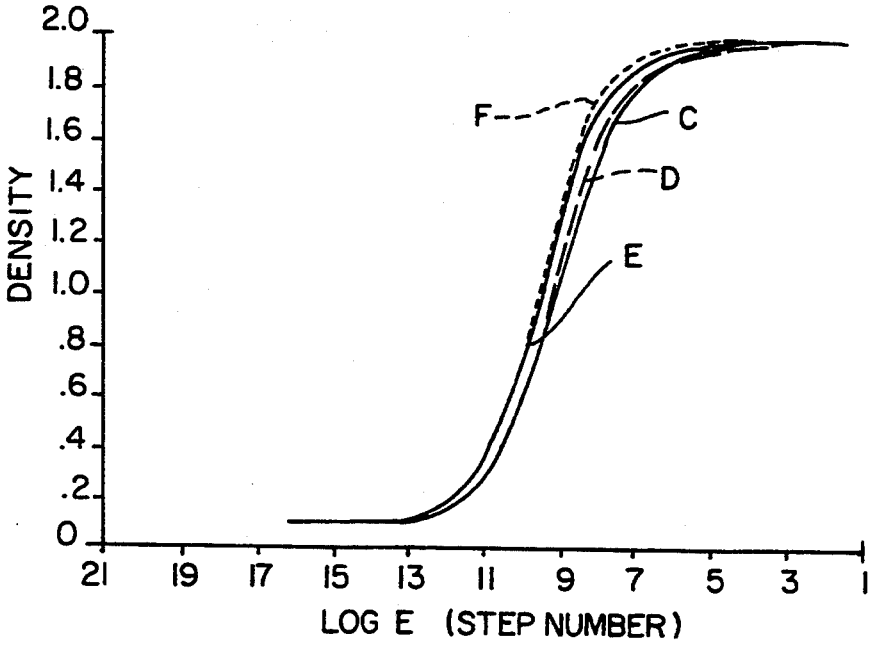
FIG. 4 is a D-Log E graph showing the high contrast characteristic curves for coatings C, D, E and F of Example 1.

The high contrast curves (blue exposure) corresponding to the samples illustrated in FIGS. 2 and 3 are shown in FIG. 4. The results in this Figure show that the high contrast characteristic curve is substantially unaffected by the method of addition of the formula (II) dye.

EXAMPLE 2

A 0.024 mol portion of a 0.34 micron silver chlorobromide (55 mol % Cl) emulsion of cubic morphology was chemically sensitized with sulfur-plus-gold and held at 40° C. A methanolic solution of dye I-1 at a concentration of 0.4 g/L was combined with a methanolic solution of dye II-1 at a concentration of 1 g/L in such proportion that when the combined solution was added to the emulsion, dye I-1 was added at a level of 0.06 mmol/Ag mol and dye II-1 was added at a level of 0.30 mmol/Ag mol. This emulsion was coated as in Example 1 to form coating G. Keeping the total amount of dye II-1 added to the emulsion equal to 0.30 mmol-/Ag mol, a first variation was prepared in which 50% of the dye II-1 was added during the chemical sensitization and 50% was added in the dye I-1 solution. This constitutes coating H. A second variation was prepared in which 100% of the dye II-1 was added during the chemical sensitization. This constitutes coating I. These three samples were then exposed and processed as described in Example 1.

Figure 5:
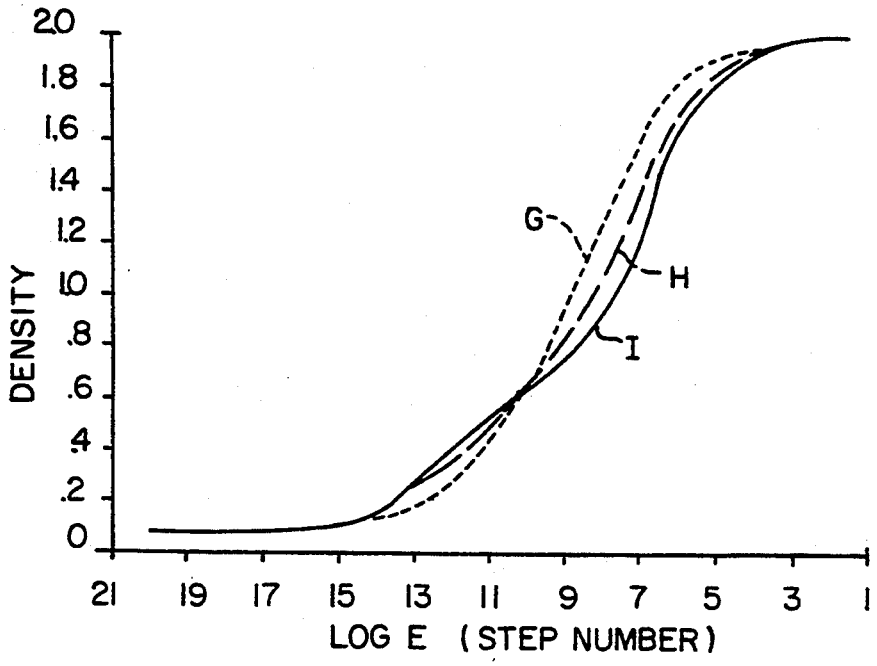
FIG. 5 is a D-Log E graph showing the low contrast characteristic curves for the three coatings of Example 2.

The low contrast characteristic curves are shown in FIG. 5. The results show that the extent to which the low contrast characteristic curve is affected by the formula (II) dye depends upon the amount of formula (II) dye added in the same solution as the formula (I) dye.

EXAMPLE 3

Figure 6:
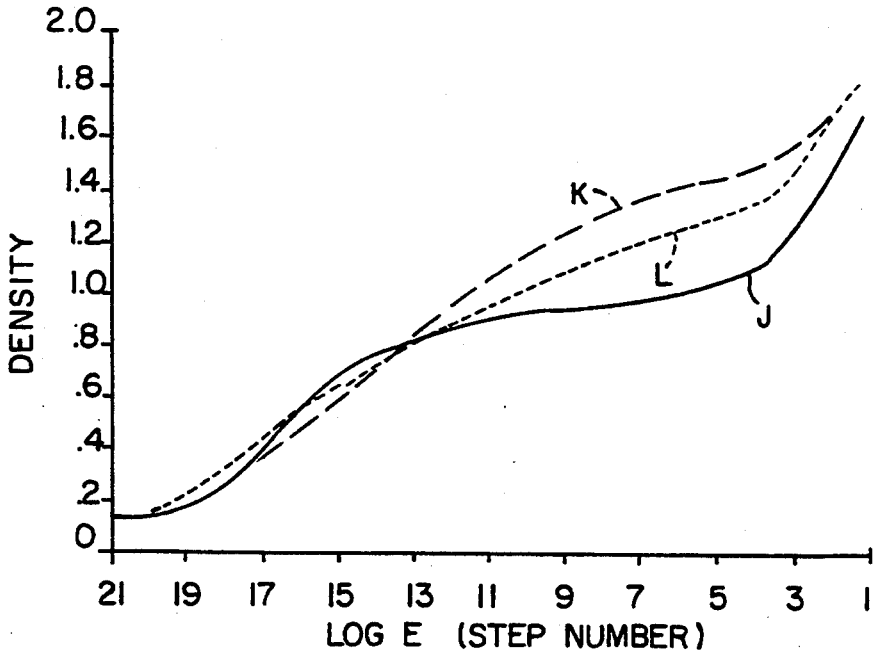
FIG. 6 is a D-Log E graph showing the low contrast characteristic curves for the three coatings of Example 3.

A sample was prepared and coated according to the method of coating E of Example 1, herein termed separate sequential addition. This constitutes coating J. A second sample was prepared and coated according to the method of coating D of Example 1, herein termed combined addition. This constitutes coating K. An additional sample was prepared and coated in which the separate solutions of dye I-1 and dye II-1 were added to the emulsion simultaneously instead of sequentially. This constitutes coating L. The coatings were exposed through a Wratten 2B+Wratten 12 filter assembly (green exposure) and processed as described in Example 1. The low contrast characteristic curves for these three coatings are shown in FIG. 6. The results show that the characteristic curve is modified by simultaneous separate addition as well as combined addition in comparison to sequential addition, and that the curve shape can be finely manipulated.

EXAMPLE 4

A sample using dye I-1 and dye II-1 was prepared according to the method of coating E of Example 1, herein termed separate sequential addition. A second sample, also using dye I-1 and II-1, was prepared according to the method of coating D of Example 1, herein termed combined addition. Additional pairs of samples were prepared using the following combinations of a variable contrast dye of formula (I) and a dye of formula (II):

I-2 and II-1; I-3 and II-1; I-4 and II-1;
I-5 and II-1; I-6 and II-1; I-7 and II-1;
I-8 and II-1; I-1 and II-2; I-1 and II-3;
I-1 and II-4.

Each pair of samples consisted of a sample prepared using the separate addition method and a complementary sample prepared using the combined addition method. The level of variable contrast dyes of formula (I) added was constant at 0.06 mmol/Ag mol and the level of dyes of formula (II) added was constant at 0.30 mmol/Ag mol. Concentrations of other dye solutions were adjusted so that a constant volume of dye solutions was used for all samples. Samples were coated, exposed, and processed as in Example 1.

Comparison of low contrast characteristic curves for the separate and combined addition methods shows that the combined addition of variable contrast dyes of formula (I) and blue dyes of formula (II) results in a photographic element having a modified characteristic curve compared to a photographic element in which the two dyes were added separately. The high contrast curve shapes were substantially unaffected in all cases.

The invention has been described in detail with particular reference to preferred embodiments thereof, but it will be understood that variations and modifications can be effected within the spirit and scope of the invention.

What is claimed is:

1. A process for controlling the silver halide grain-to-grain distribution of a variable contrast spectral sensitizing dye in a light sensitive silver halide emulsion layer of a variable contrast photographic element comprising the process steps of:

(a) adding a variable contrast sensitizing dye of formula (I) to a silver halide emulsion which comprises cubic, octahedral or spherical grains:

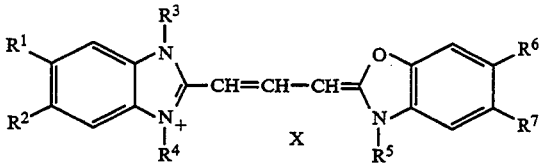

(I)

wherein $R^1$, $R^2$, $R^6$ and $R^7$ each independently represent hydrogen, halogen, hydroxy, or substituted or unsubstituted alkyl, alkenyl, alkoxy, alkylamino, alkylthio, aryl, aryloxy, arylamino, or arylthio;

$R^3$, $R^4$ and $R^5$ each independently represent substituted or unsubstituted alkyl or aryl; and X represents a counterion as needed to balance the charge of the molecule;

(b) adding a sensitizing dye of formula (II) to the silver halide emulsion:

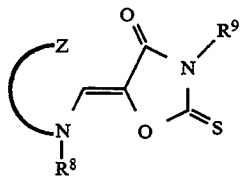

(II)

wherein

Z represents the atoms necessary to complete a five- or six-membered heterocyclic ring;

$R^8$ represents substituted or unsubstituted alkyl or aryl; and $R^9$ represents hydrogen, substituted or unsubstituted alkyl or aryl, or a heterocycle; and (c) coating the emulsion on a support;

wherein the formula (I) and formula (II) sensitizing dyes are added to the emulsion at substantially the same time, and the formula (I) dye is added in an amount less than that required to impart maximum sensitivity to all of the silver halide in the emulsion.

2. The process of claim 1 wherein one of $R^3$, $R^4$ and $R^5$ is alkyl substituted with an anionic substituent.

3. The process of claim 2 wherein one of $R^3$, $R^4$ and $R^5$ is sulfoalkyl.

4. The process of claim 2 wherein $R^2$ is trifluoromethyl and $R^7$ is phenyl.

5. The process of claim 2 wherein Z represents the atoms necessary to complete a pyridine, oxazole, thiazole, benzoxazole, or benzothiazole ring.

6. The process of claim 5 wherein $R^8$ and $R^9$ each represent unsubstituted alkyl of from 1 to 4 carbon atoms.

7. The process of claim 5 wherein the dye formula (I) and the dye of formula (II) are in separate solutions which separate solutions are added to the emulsion.

8. The process of claim 5 wherein the dye of formula (I) and the dye of formula (II) are in the same solution which solution is added to the emulsion.

9. The process of claim 1 wherein Z represents the atoms necessary to complete a pyridine, oxazole, thiazole, benzoxazole, or benzothiazole ring.

10. The process of claim 1 wherein $R^8$ and $R^9$ each represent unsubstituted alkyl of from 1 to 4 carbon atoms.

11. The process of claim 1 wherein the dye of formula (I) and the dye of formula (II) are in separate solutions which separate solutions are added to the emulsion.

12. The process of claim 1 wherein the dye of formula (I) and the dye of formula (II) are in the same solution which solution is added to the emulsion.

13. The process of claim 1 wherein the amount of dye of formula (I) added to the emulsion is sufficient to achieve a mono-layer of dye adsorbed to about 0.5 to 20% of the silver halide grain surface area.

* * * * *